United States Patent [19]

Melconian

[11] Patent Number: 4,996,838

[45] Date of Patent: Mar. 5, 1991

[54] ANNULAR VORTEX SLINGER COMBUSTOR

[75] Inventor: Jerry O. Melconian, Reading, Mass.

[73] Assignee: Sol-3 Resources, Inc., Reading, Mass.

[21] Appl. No.: 559,423

[22] Filed: Jul. 26, 1991

Related U.S. Application Data

[63] Continuation of Ser. No. 263,060, Oct. 27, 1988, abandoned, which is a continuation-in-part of Ser. No. 236,748, Aug. 26, 1988, abandoned.

[51] Int. Cl.[5] ..... F02K 3/00; F23R 3/12

[52] U.S. Cl. ..... 60/39.36; 60/732; 60/755

[58] Field of Search ..... 60/755, 756, 759, 39.36, 60/732, 748, 39.464; 431/352

[56] References Cited

U.S. PATENT DOCUMENTS

| | | | |
|---|---|---|---|
| 2,718,757 | 9/1955 | Bloomer et al. | 60/755 |
| 4,040,251 | 8/1977 | Heitmann et al. | 60/745 |
| 4,695,247 | 9/1987 | Enzaki et al. | 60/756 |
| 4,845,941 | 7/1989 | Paul | 60/39.36 |

OTHER PUBLICATIONS

Carlstrom, L. A. et al., "Improved Emissions Performance in Today's Combustion System," AEG/SOA 7805, Jun. 14–17, 1978, p. 17.

*Primary Examiner*—Louis J. Casaregola
*Assistant Examiner*—Timothy S. Thorpe
*Attorney, Agent, or Firm*—Joseph S. Iandioria

[57] ABSTRACT

A circumferentially stirred variable residence time vortex slinger combuster, includes a primary combustion chamber for containing an annular combustion vortex and a first group of louvres peripherally disposed about the primary combustion chamber and distributed along its primary axis. The louvres are inclined to impel air circumferentially about the primary axis within the primary combustion chamber to cool its interior surfaces, to impel air inwardly to assist in driving the annular combustor vortex in a helical path, and to feed combustion in the primary combustion chamber. The slinger combustor further includes a second annular combustion chamber and a narrow annular waist region interconnecting the output of the primary combustion chamber with the second annular combustion chamber. The waist region passes only lower density particles and traps higher density particles for substantial combustion in the annular combustion vortex of the primary annular combustion chamber. At least one fuel nozzle, rotating about the primary axis, introduces fuel into the primary annular combustion chamber.

26 Claims, 7 Drawing Sheets

ANNULAR VORTEX SLINGER COMBUSTOR

This application is a continuation of Ser. No. 07/263,060, filed Oct. 27, 1988, now abandoned, which is a continuation-in-part of Ser. No. 07/236,748, filed Aug. 26, 1988, now abandoned.

FIELD OF INVENTION

This invention relates to a multichamber (multizone) annular vortex combustor, and more particularly to a slinger combustor which provides variable residence time to achieve complete combustion of fuel particles.

BACKGROUND OF INVENTION

A number of combustors are configured to enhance combustion by inducing one or more vortices of fuel particles entrained in air. To varying degrees, however, each of these combustors is plagued with problems of variable fuel particle size, uniform residence time, and cooling of the interior surfaces of the combustor.

Fuel particles are typically distributed over a size range inside the combustor. The large-sized particles experience the same residence time in conventional combustors as do smaller particles; the time is often insufficient to completely combust these larger fueled particles except within the peak power range of the combustor. The efficiency of most combustors noticeably decreases outside their peak power ranges.

Conventional slinger combustors have a rotating fuel nozzle which sprays fuel about the inside of a combustion chamber. However, large-sized particles are not properly combusted.

It is desirable to operate combustors at high pressures to increase the efficiency of the combustors. However, cooling problems increase as the pressure increases since compressed air burns hotter than at atmospheric pressure. Some combustors develop internal temperatures of 4000° F. or more which would melt their surfaces if directly contacted by those temperatures. Typically, the outer surface of the combustor is cooled with air circulating around the combustor before the air is introduced into the combustor. In many combustors, cooling steps are provided which introduce air in a direction parallel to the interior surface of the combustor to induce a blanket of air which insulates the interior surface from the combustion gases. However, often 40% of the air introduced into a combustor is used for cooling and not for combustion. The large volume of air required for cooling causes a poor combustion exit temperature distribution which in turn requires additional cooling of the turbines.

Tanasawa, U.S. Pat. No. 3,808,802, describes a vortex combustor which burns fuel-air mixture in a central, forced vortex zone of a first cylindrical combustion chamber and in the outer natural vortex zone of a second cylindrical combustion chamber. There are a number of differences between combustors as taught by Tanasawa and variable residence time combustors according to this invention, described infra, e.g., control of fuel particle residence time, presence of louvres in the vicinity of primary combustion, control of the combustion vortex, and cooling of internal surfaces.

After fuel particles are combusted within primary and secondary combustion zones in conventional combustors, the combustion gases are cooled in a dilution zone in which air is provided to dilute the combustion gases. When a solid fuel such as coal is burned, ash and other by-product particulates are said from the system using a scroll, also known as a cyclone separator, that is presently positioned downstream of the dilution zone.

SUMMARY OF INVENTION

It is therefore an object of this invention to provide an improved annular multichamber (multizone) vortex slinger combustor which causes circumferential mixing of fuel and air and hence an improved combustor exit temperature distribution.

It is a further object of this invention to provide an improved annular multichamber vortex slinger combustor which establishes a variable residence time for fuel particles.

It is a further object of this invention to provide an annular vortex slinger combustor which traps higher density fuel particles to ensure fragmentation and combustion of the particles.

It is a further object of this invention to provide such an annular multichamber multizone vortex slinger combustor which more fully utilizes combustion air to cool internal surfaces of the combustor.

It is a further object of this invention to provide such an annular multichamber vortex slinger combustor which utilizes the swirling component of pressurized air from a compressor to drive a combustion vortex.

It is a further object of this invention to provide such an annular multichamber vortex slinger combustor which enables tailoring of the vortex to adjust residence time for fuel particles of different densities and size.

It is a further object of this invention to provide such an annular multichamber vortex slinger combustor which is compact and light in weight.

It is a further object of this invention to provide such an annular multichamber vortex slinger combustor which reduces the number of fuel nozzles.

It is a further object of this invention to provide such an annular multichamber vortex slinger combustor which has more efficient vanes that direct combusted air to the blades of a turbine.

It is a further object of this invention to provide such an annular multichamber vortex slinger combustor which maintains the swirl component of air flow from the compressor to drive the combustion vortex.

It is a further object of this invention to provide such an annular multichamber vortex slinger combustor which eliminates compressor exit stators.

It is a further object of this invention to provide such an annular multichamber vortex slinger combustor which reduces the pressure loss required to introduce pressurized air into the combustion chamber.

It is a further object of this invention to provide such an annular multichamber vortex slinger combustor which provides uniformly high combustion efficiency throughout its power range.

It is a further object of this invention to provide such an annular multichamber vortex slinger combustor which can eliminate ash and other by-products directly from the primary combustion chamber of the combustor.

It is a further object of this invention to provide such an annular multichamber vortex slinger combustor which minimizes the formation of nitrogen oxides by Rich burn-Quick Quench-Lean burn air distribution to the combustor.

This invention results from the realization that a truly effective multichamber, vortex slinger combustor can be achieved by distributing a group of louvres peripherally about a primary annular combustion chamber to impel air about the chamber for cooling its interior surfaces and to direct air inwardly for tailoring and assisting in driving a combustion vortex in the primary annular combustion chamber and for feeding combustion by introducing fuel from a rotating fuel nozzle about a primary axis into the primary annular combustion chamber, and by interconnecting the primary annular combustion chamber to a second annular combustion chamber with a narrowed waist region which, in cooperation with air impelled by the louvres, passes only lower density particles to the second annular combustion chamber and traps higher density particles in the combustion vortex for substantially complete combustion. It is a further realization that radially opposed air jets at the narrowed waist provides impinging air for quickly quenching the products exiting the primary combustion chamber to maintain a low gas temperature and minimize the formation of nitrogen oxides.

This invention features a variable residence time annular, slinger vortex combustor. The combustor includes a primary annular combustion chamber for containing an annular combustion vortex. The first group of louvres are peripherally disposed about the primary combustion chamber and distributed along its primary axis. The louvres are inclined to impel air circumferentially about the primary axis within the primary combustion chamber to cool its interior surfaces, to impel air inwardly, to assist in driving the annular combustion vortex in a helical path, and to feed combustion in the primary combustion chamber. A narrow annular waist region interconnects the output of the primary combustion chamber with a second annular combustion chamber. The waist region passes only lower density particles and traps higher density particles in the annular combustion vortex in the primary annular combustion chamber for substantial combustion. The slinger combuster further includes means for introducing fuel from at least one fuel nozzle, rotating about the primary axis, into the primary annular chamber.

In one construction, the secondary annular combustion chamber includes a second group of louvres inclined to drive air within the secondary annular combustion chamber in approximately the same helical path as established by the first group of louvres in the primary annular combustion chamber. These louvres also cool the inner surfaces of the second annular combustion chamber and assist in cooling combustion gases. The first group of louvres, peripherally disposed about the primary combustion chamber, are inclined to circumferentially drive air within the primary combustion chamber for establishing a vortex generally centered about the primary axis of the primary combustion chamber. The louvres may be inclined to impel air approximately tangential to the surfaces of the walls of the primary combustion chamber.

The second group of louvres along the second annular combustion chamber may be inclined to tailor the helical path of the combustor exit gases to that acceptable to a turbine. Radially opposing air jets may also be included in the waist region to quench the combustion gases and minimize the formation of nitrogen oxides.

The annular combustion chamber may include inner and outer cylindrical walls which define a first set of louvres in the first group. In one construction, the cylindrical walls are formed by a plurality of plates successively arranged about the primary axis to establish a plurality of junctions. Each of the plates may include interlocking means for interconnecting that plate with adjacent plates. Defined at each junction is at least one slot for establishing at least one louvre. In an alternate construction, the plurality of plates have portions that overlap adjacent plates to establish a junction. Spacer means are exposed between the overlapping portions of the adjacent plates for securing the overlapping plates in a spaced relationship to define louvres therebetween. A plurality of plates may be made from ceramic.

In an alternative construction, the slinger combustor further includes a second group of louvres peripherally disposed about the secondary combustion chamber. The secondary combustion chamber includes an outer cylindrical wall defining a first set of louvres in the second group and an inner cylindrical wall, coaxial with the outer wall, defining a second set of louvres in the second group. Air feed vanes, connected between the inner and outer walls, feed air to the fourth set of louvres. The air feed vanes are inclined to enhance air flow in a direction to the fourth set of louvres to assist in driving the annular combustion vortex. Further, the air feed vanes are skewed to tailor swirling air flow in the secondary chamber in a direction that is acceptable to a turbine.

DISCLOSURE OF PREFERRED EMBODIMENTS

Other objects, features and advantages will occur to those skilled in the art from the following description of preferred embodiments and the accompanying drawings, in which.

Figure 6:
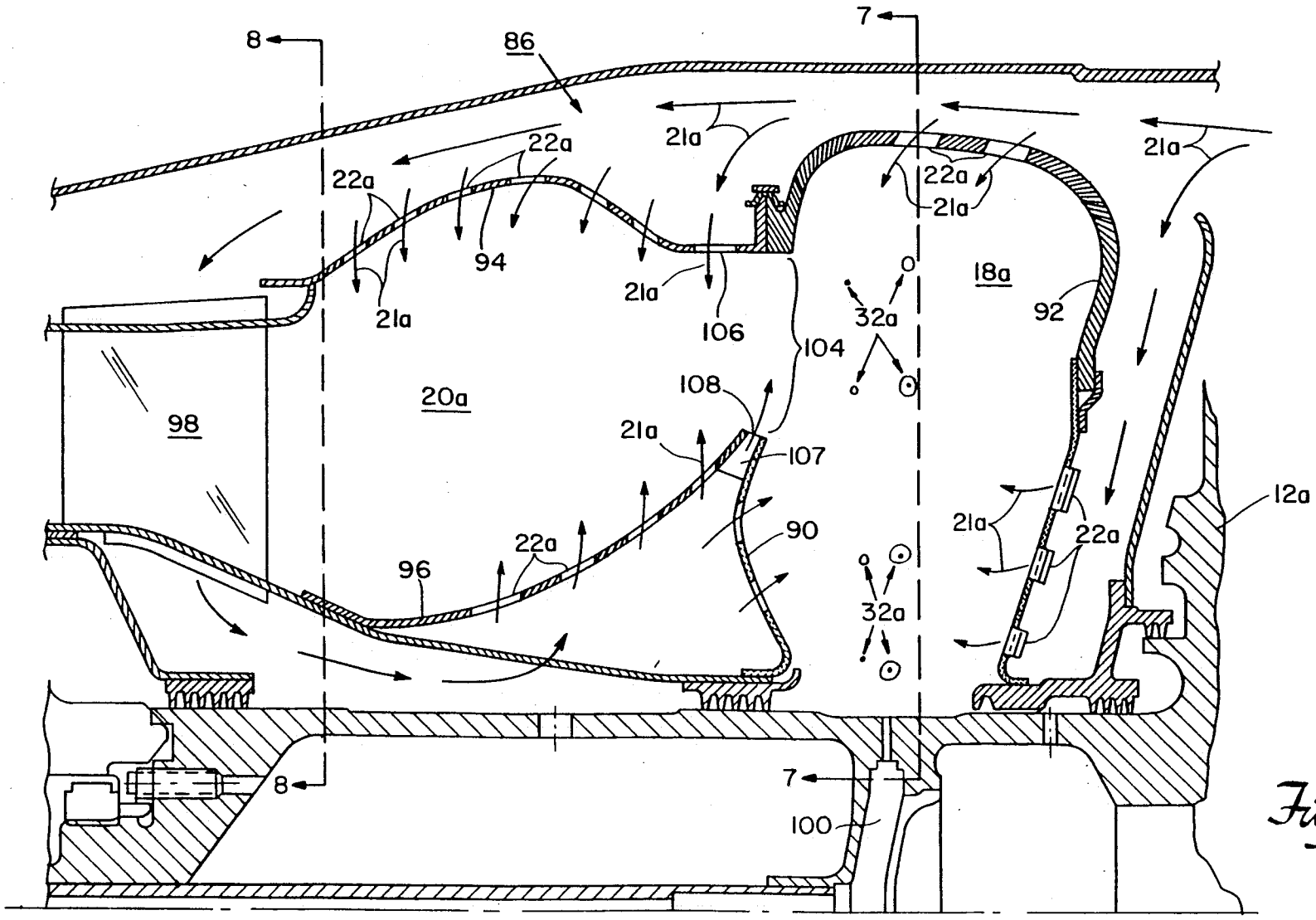
FIG. 6 is a partial schematic cross-sectional view of a turbine engine including a compressor and an annular vortex, slinger combustor according to this invention.
Figure 7:
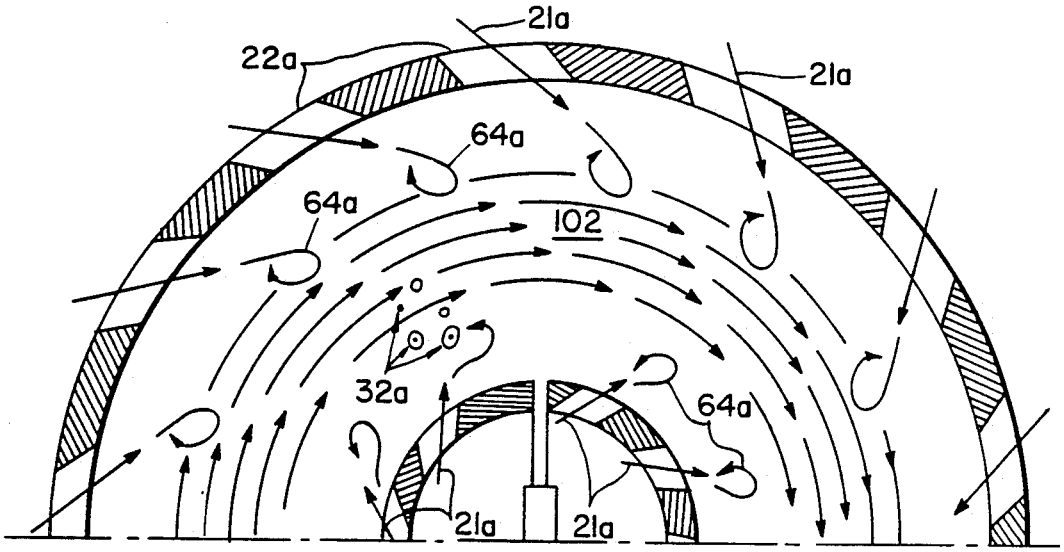
Figure 8:
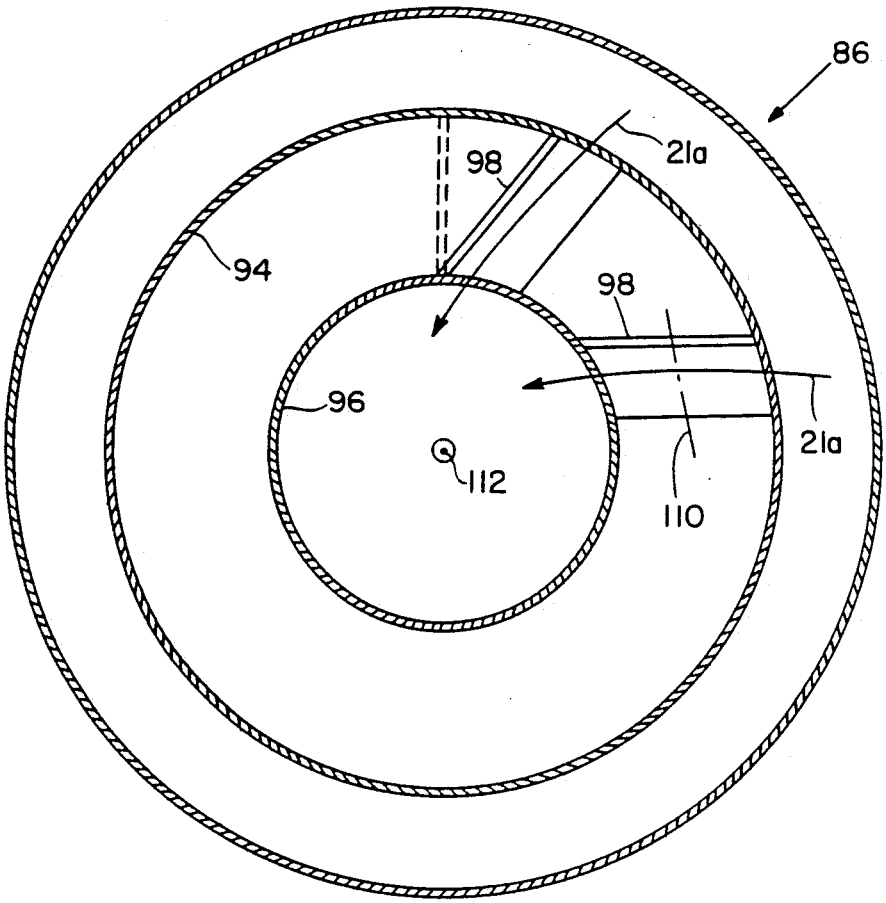

FIG. 7 is a cross-sectional view along line 7—7 of the annular vortex slinger combustor of FIG. 6 illustrating the transverse flow pattern of fuel particles in the primary chamber of the slinger combustor; and FIG. 8 is a cross-sectional view along 8—8 of the annular vortex slinger combustor of FIG. 6 showing air fuel vanes for feeding air at an angle to the inner wall of the combustor and for guiding directing combusted air to the turbine.

This invention may be accomplished by a multichamber annular vortex slinger combustor described in FIGS. 6–8, which has a primary annular combustion chamber containing a number of louvres distributed both peripherally about the primary annular combustion chamber and along its primary axis. The louvres impel axial and circumferential velocities of pressurized air from a compressor about the annular interior of the chamber to cool its interior surfaces and impel air inwardly to assist in driving a combustion vortex in a helical path about the major axis of the primary combustion chamber. A narrow annular waist region separates the primary annular combustion chamber from a secondary annular combustion chamber. The waist region permits only lower density fuel particles introduced into the primary chamber by fuel injectors, rotating about the primary axis, to pass to the secondary combustion chamber while trapping higher density particles in the combustion vortex of the primary combustion chamber for fragmentation and substantial combustion of those particles. The waist region is provided with radically opposing air jets which penetrate into the combustor to quench the hot gaseous products from the primary chamber and control the maximum gas temperature, thus minimizing the formation of nitrogen oxides.

In one construction, the secondary annular combustor includes a second group louvres to drive air about the secondary annular combustion chamber in approximately the same helical path established by the louvres in the primary annular combustion chamber, to cool the inner surfaces of the second annular combustion chamber, and to assist in cooling combustion gases. These louvres are also inclined to tailor the helical path of the combustor exit gases to that acceptable to a turbine.

The variable residence time vortex slinger combustor in this construction is well-suited for combusting a mixture of fuel compounds such as coal, coal-oil, or coal-water mixtures.

Figure 1:
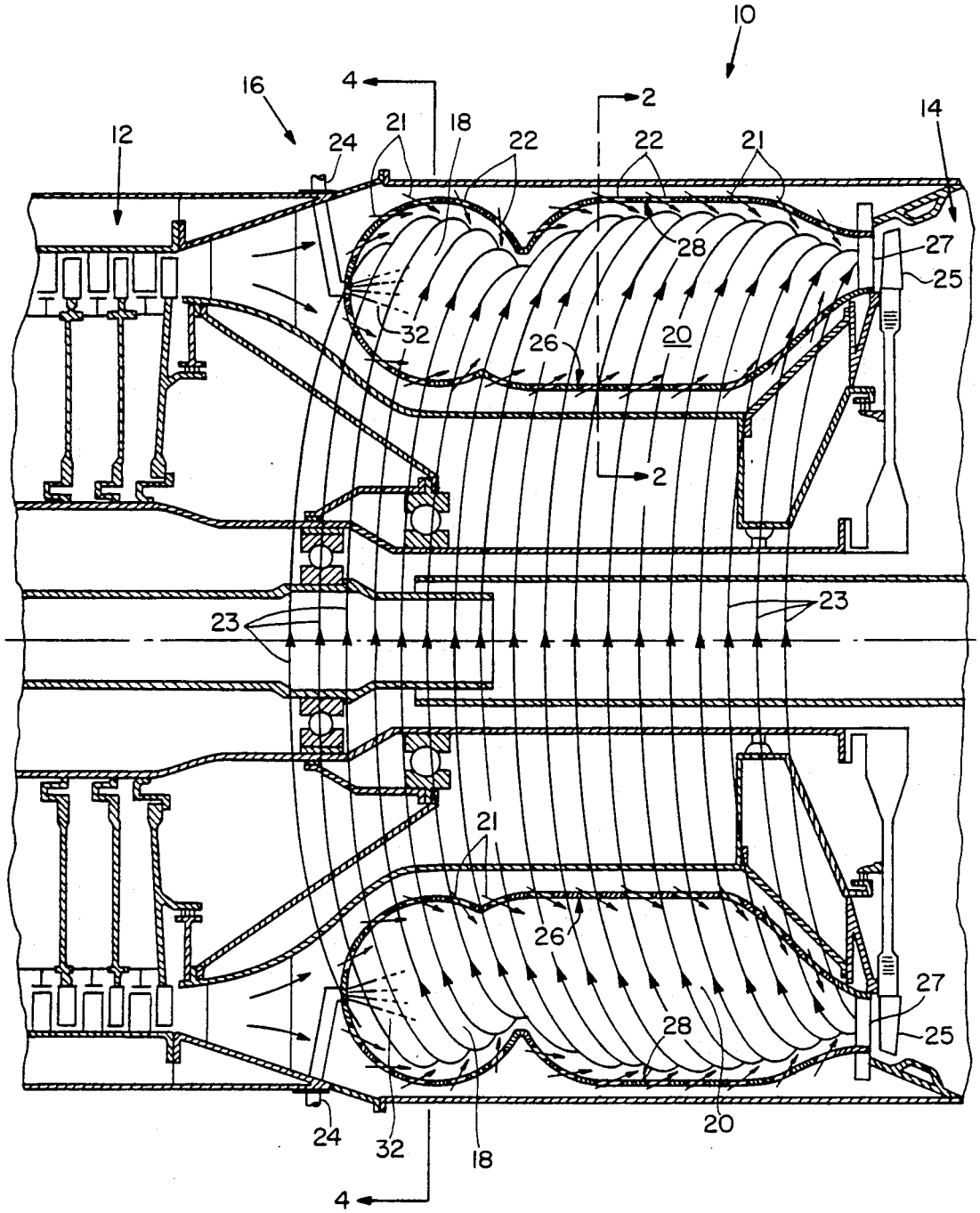
FIG. 1 is a schematic cross-sectional view of a turbine engine including a compressor, an annular vortex combustor and a turbine.

The general concept of a variable residence time annular vortex combustion is shown in FIGS. 1–5 and is described below. Variable residence time annular vortex combustor 10 is shown in FIG. 1 as a component between a compressor 12 and a turbine 14 of a gas turbine engine 16. Compressor 12 is a conventional compressor which compresses ambient air and immerses combustor 10 in pressurized air. Characteristically, air exiting compressor 12 has axial and circumferential velocities. Combustor 10 includes a primary annular combustion chamber 18 and a secondary annular combustion chamber 20. Louvres 22 are peripherally disposed circumferentially about the inner and outer walls 26, 28 of chambers 18 and 20 and longitudinally along the primary axis of combustor 10. Louvres 22 are fixed tangential slots which direct air, indicated by arrows 21, into primary and secondary chambers 18, 20 and helically about the primary axis of turbine engine 16 as indicated by arrows 23. Louvres 22 located at secondary combustor chamber 20 are inclined to direct the swirling air 23 so that it strikes blades 25 of turbine 14. Air feed vanes 27 may be located between combustor 10 and turbine 14 to impart a helical trajectory to the combustor exit gases compatible with the blades 25 of turbine 14. Fuel 32 is circumferentially introduced into primary annular combustion chamber 18 by fuel injectors 24 and entrained in air by the helical motion of pressurized air 23.

Figure 2:
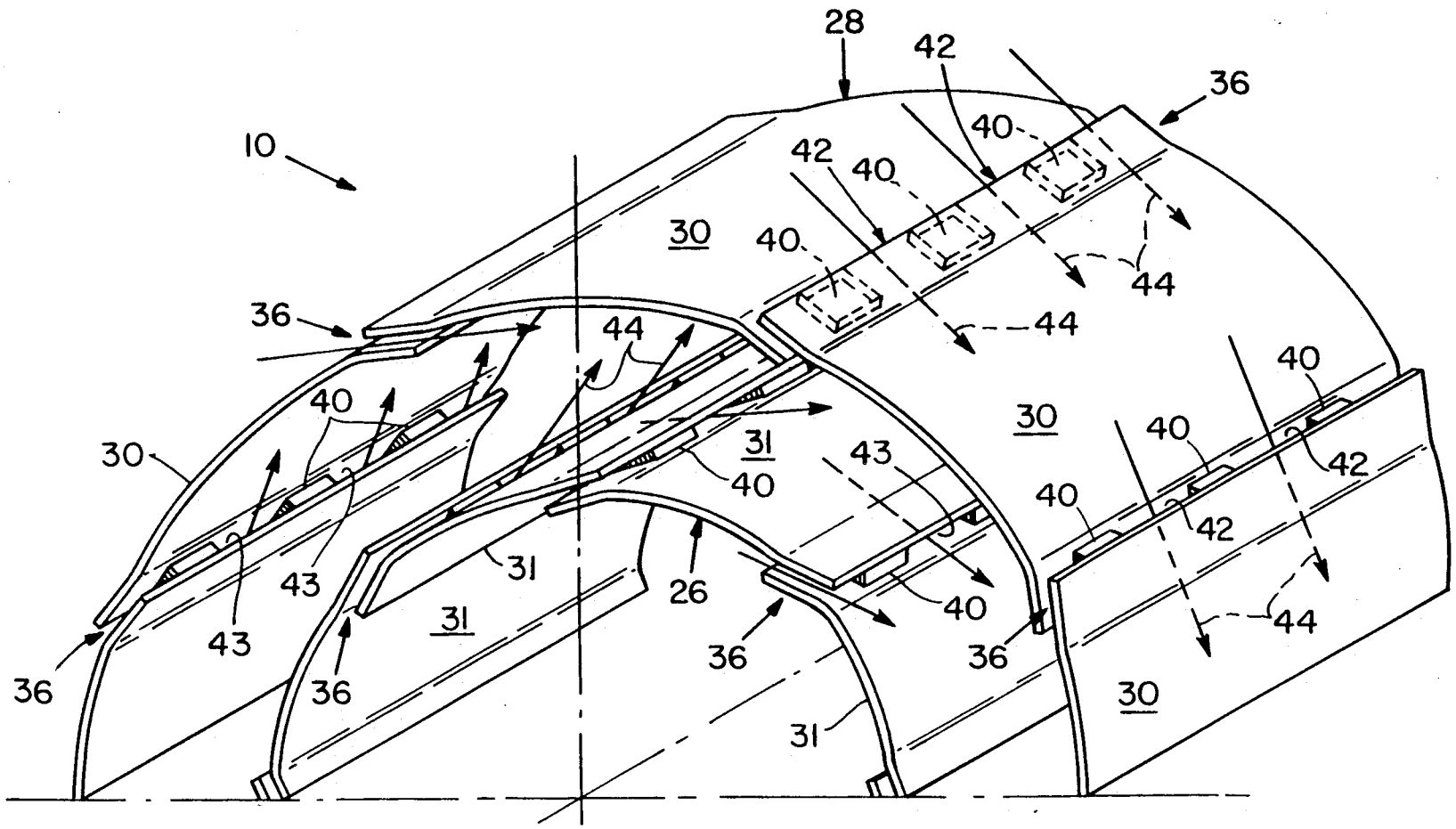
FIG. 2 is a three-dimensional, cross-sectional view taken along line 2—2 of FIG. 1 of a portion of the combustor illustrating its wall construction.

The construction of inner and outer walls 26 and 28 of combustor 10 are shown in greater detail in FIG. 2. Each wall consists of a series of plates 30 and 31 which are successively arranged about the primary axis to form inner and outer cylindrical walls 26, 28. Each series of plates 30 and 31 includes overlapping plate portions 36 which are spaced by spacers 40 to define slots 42 and 43, respectively. These slots 42, 43 operate as louvres for introducing air into combustor 10, as indicated by arrows 44. Slots 42 and 43 are situated so that air enters combustor 10 approximately tangent to the surfaces of walls 26 and 28. Louvres constructed in this manner are compatible with the path of the air flow supplied by compressor 12. The number of slots 42 and 43 as well as their exact angle of inclination may vary depending on the size, pressure, and temperature constraints of the combustor.

Figure 3:
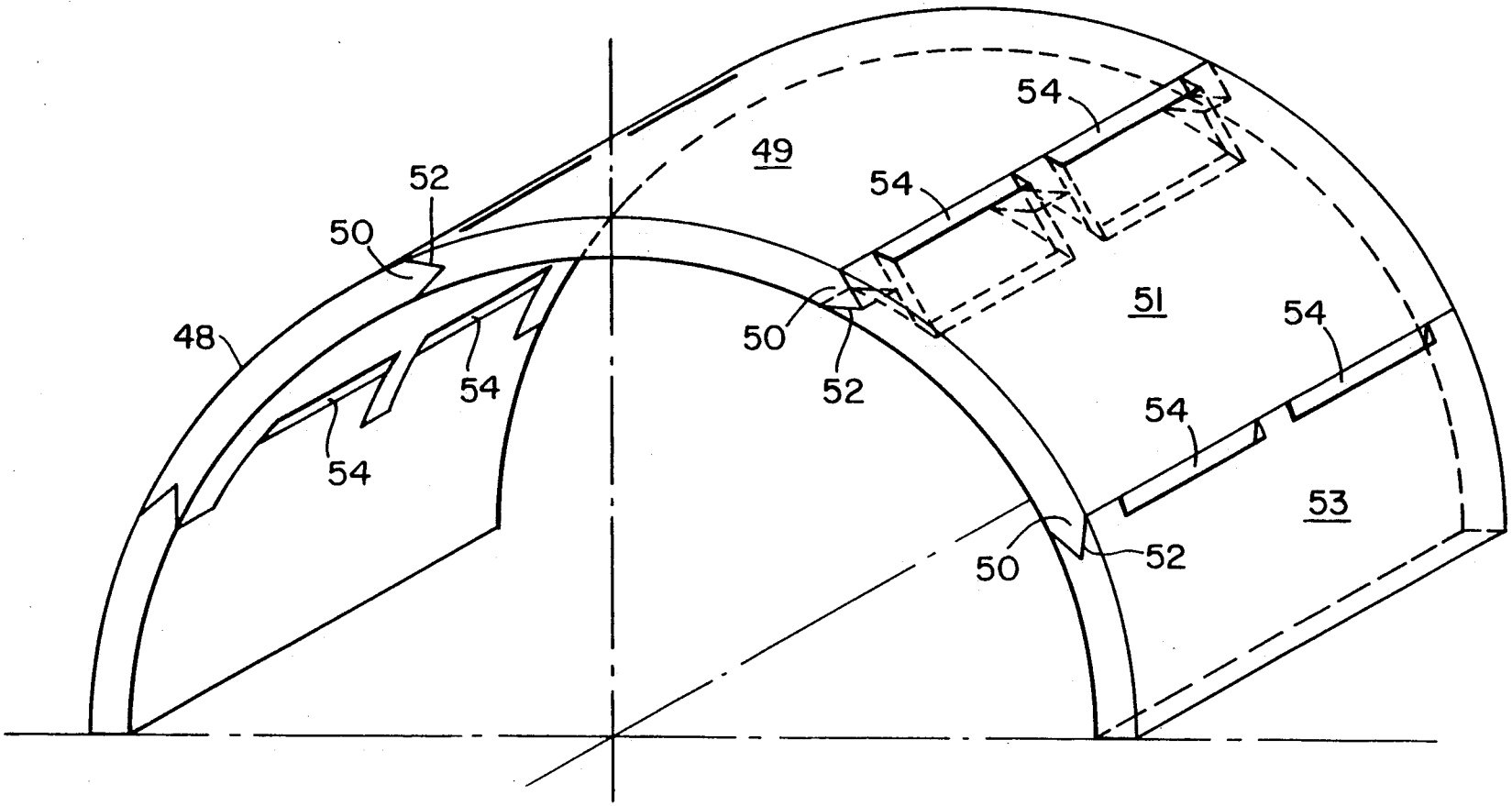
FIG. 3 is a three-dimensional cross-sectional view of an alternate wall construction for the combustor shown in FIG. 1.
Figure 4:
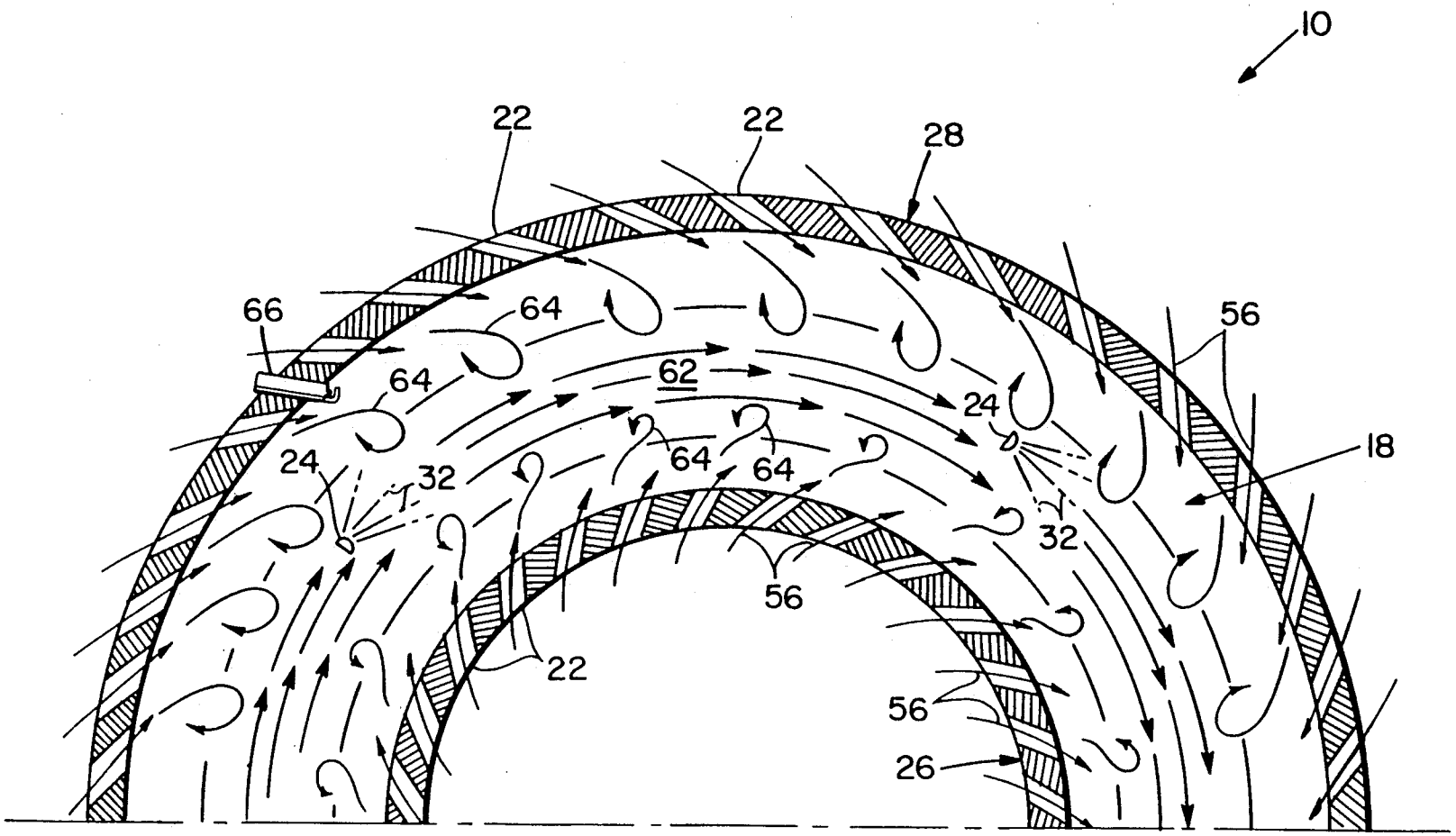
FIG. 4 is a cross-sectional view along line 4—4 of the annular vortex combustor of FIG. 1 illustrating the transverse flow pattern in the primary chamber of the combustor.

In an alternate construction, walls 26 and 28 of combustor 10 are assembled from interlocking curvilinear ceramic plates 48, 49, 51, 53 as shown in FIG. 3. Each plate 48, 49, 51, 53 includes a tongue and groove portion 50, 52 which mate to a groove and tongue portion, 52, 50 of an adjacent plate, respectively. Tangential slots 54 are formed at the junction of two plates and are used for introducing air into combustor 10. In the preferred embodiment these slots 54 are formed along the groove portions 52, but may be formed along the tongue portions 50 or a combination of both. Forming slots at the junctions of two plates 48 improves the durability of the plates.

The variable residence time combustor enables adjustment of the residence time of fuel particles according to the density and size of those fuel particles within primary combustion chamber 18. The flow pattern of the fuel-air mixture in primary annular combustion chamber 18 is shown in greater detail in FIG. 4. Higher pressure air, indicated by arrows 56, passes over the exterior surfaces of inner and outer walls 26 and 28, respectively, and is drawn through louvres 22 to the hot gases of the combustion vortex 62, since it has a lower density. Since the pressurized air is introduced approximately tangential to the surfaces of walls 26 and 28, it also cools the inner surfaces of walls 26 and 28 before combining with the hot gases of vortex 62. When the higher pressure air comes into contact with the hot gases of vortex 62, combustion vortex 62 is compressed and eddy currents 64 are created which assist in aerodynamically vaporizing and mixing fuel 32 as it is introduced by fuel injector 24. The combustion vortex is initially created by igniting the fuel rich mixture using an ignitor 66.

Figure 5:
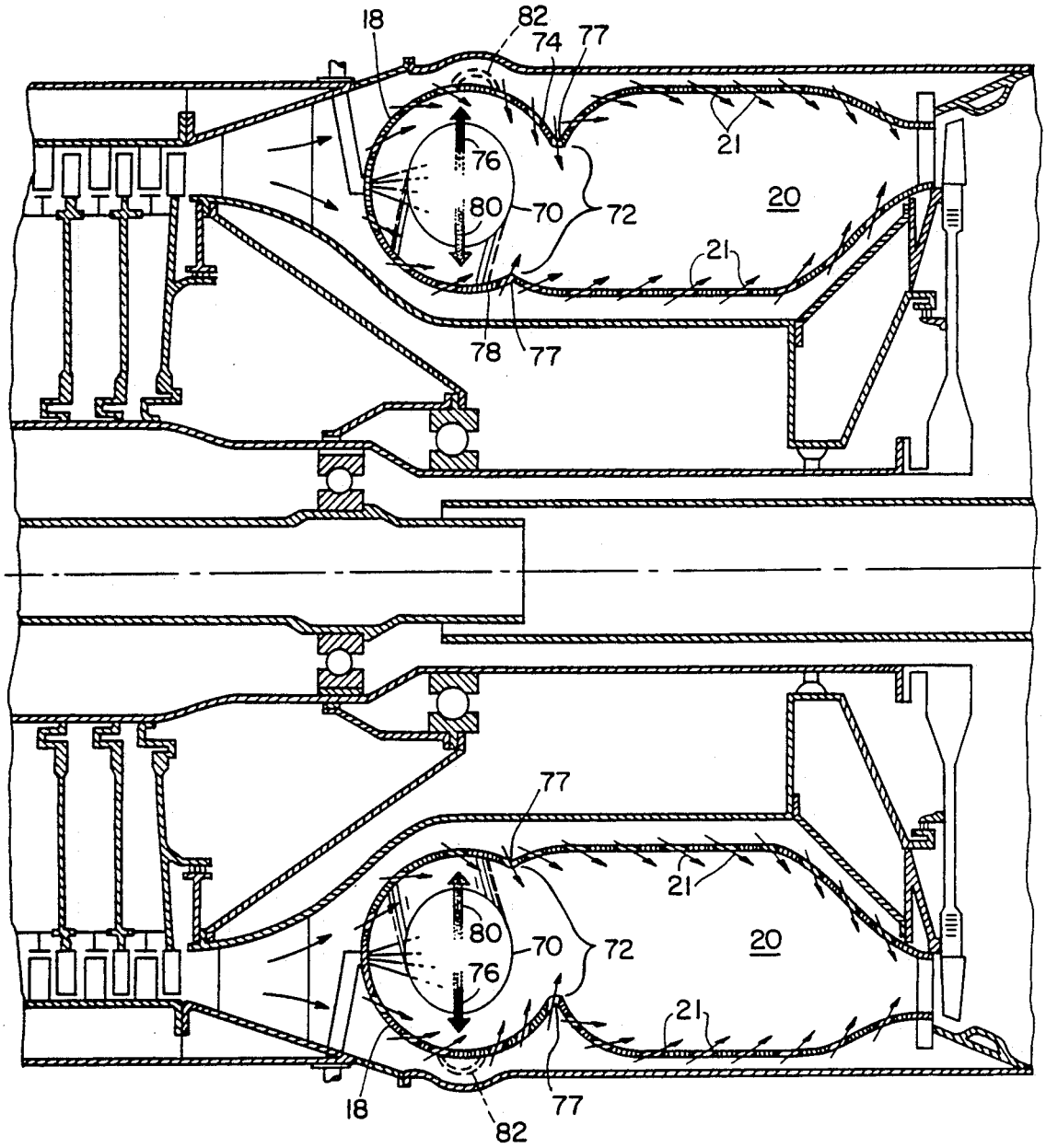
FIG. 5 is a schematic cross-sectional view of an annular vortex combustor of FIG. 1 illustrating the flow of fuel and gases and their variable residence time.

Swirling components of the pressurized air are directed by louvres 22 which radially and longitudinally locate the combustion vortex to create a torus 70 as shown in FIG. 5. Torus 70 is a toroidal configuration of combustion gases which includes trapped higher density particles. Centrifugal force drives denser particles to the outer portion of torus 70, as indicated by arrow 76. These particles are trapped for a substantial time to complete combustion in primary annular combustion chamber 18 by waist region 72 before passing to secondary annular combustion chamber 20. The air jets formed at the waist region along outer wall 74 are aligned with air jets formed at the waist region along inner wall 78 so that they are radially opposed to each other for quickly quenching the products exiting the primary combustion chamber to maintain a low gas temperature and to minimize the formation of nitrogen oxides. In chamber 20 the combustion of unburned gaseous products is completed.

As the trapped higher density particles are fragmented and combusted in primary annular combustion chamber 18, smaller, hotter, and therefore less dense particles travel inwardly in the direction indicated by arrow 80. The lightest, hottest particles escape past waist region 72 as combustion gases. Additional pressurized air entering through air jets 77 in the waist region penetrates the core of the combustion vortex to provide additional air for quenching and further combustion. Thus, a temperature gradient is established through torus 70 with the highest temperature situated near the primary axis, and the lowest temperature situated near the surfaces of primary combustion chamber 18. With such a temperature gradient the combustion heat experienced by those surfaces is reduced.

Approximately 80 percent or more of combustion is accomplished in the primary combustion chamber 18. Incompletely combusted gases such as carbon monoxide and unburned hydrocarbon are burned in secondary combustion chamber 20. Louvres 22 of the secondary combustion chamber 20 compel pressurized air, indicated by arrows 21, tangentially in a rotational direction that is approximately equal to the helical path established by louvres 22 of the primary combustion chamber 18. This air flow cools the combusted gases and directs the combustor exit gases in a direction that is acceptable to turbine blades 25.

Variable residence time combustor 10 not only provides uniform high combustion efficiency throughout its power range but also accepts a variety of fuel mixtures. When coal, coal-oil, or coal-water slurries are combusted, it is desirable to provide primary combustion chamber 18 with scroller 82, indicated in phantom in FIG. 5. Ash and other high density by-products are carried by the centrifugal force radially outward from torus 70, to the opening of scroller 82, not shown. As combustion vortex rotates the most dense particles are spun through circumferential openings and travel through a scroller where they are exhausted through outlets. Unlike the placement of scrollers on conventional combustors, scroller 82 is radially based from the combustor vortex at the region of primary combustion. The by-products are thereby eliminated as soon as possible to minimize their interference with the combustion process.

Similar to the circumferentially stirred variable time vortex combustor described above, a slinger combustor 86, FIG. 6, according to the present invention, includes a primary combustion chamber **18*a* and a secondary combustion chamber 20*a*, which correspond to reference numbers 18 and 20, respectively, in FIG. 1. Both primary chamber 18*a* and secondary chamber 20*a* consists of inner and outer walls 90, 92 and 94, 96, respectively, having louvres 22*a* peripherally disposed about its primary axis. Preferably inner wall 90 of primary chamber 18*a* is made from interconnected ceramic plates as illustrated in FIG. 3 to withstand higher temperatures. However, this wall as well as the other walls may be made from overlapping layers of sheet metal as illustrated in FIG. 2**.

As described above, louvres **22*a* are fixed tangential slots which direct swirling air from compressor 12*a*, indicated by arrows 21*a*, into primary and secondary chambers 18*a*, 20*a* in a helical path about the primary axis of combustor 86. Air feed vanes 98, distributed about the primary axis and connected between outer and inner walls 94, 96 of secondary chamber 20, feed swirling air from compressor 12*a* to louvres 22*a* located on inner walls 90 and 96**.

Fuel particles **32*a*, which may vary in size and density are circumferentially introduced into primary combustion chamber 18*a* by at least one fuel nozzle 100, rotating about the primary axis. The fuel particles 32*a* are entrained in air by the helical motion of pressurized air introduced in to primary chamber 18*a* by louvres 22*a***.

The flow pattern of the fuel particles **32*a* within primary combustion chamber 18*a*, is shown in greater detail in FIG. 7. Pressurized air, indicated by arrows 21*a*, passes over the exterior surfaces of inner and outer walls 90 and 92 and is driven through louvres 22*a* to the hot gases of the combustion vortex indicated by arrows 102. Since this air has a higher density than the hot gases of the vortex, eddy currents 64*a* are created which assist in mixing and vaporizing the fuel particles 32*a***.

Centrifugal forces drive denser fuel particles **32*a*, FIG. 6, to the outer wall 92 where they are trapped for a substantial time to complete combustion in primary annular combustion chamber 18*a* by waist region 104. As the denser particles are fragmented and combusted, the lighter, hotter fuel particles escape past waist region 104 as combustion gases. As combustion gases pass through waist region 104, pressurized air entering through air jets 106, 108 in waist region 104 penetrate the core of combusted gases to provide additional air for quenching and further combustion. Preferably, air jets 106 consists of angled plates 107, which control the direction of pressurized air introduced at waist region 104, for penetrating the core of the combustion vortex to provide additional air for quenching and further combustion. Incompletely combusted gases are then burned in secondary combustion chamber 20*a***.

Pressurized air entering louvres **22*a* of secondary combustion chamber 20*a* cools the combusted gases and maintains the helical path established by louvres 22*a* of primary combustion chamber 18*a*. The combusted gases are then directed by the air feed vanes 98, FIG. 8, which are skewed from a radial position, shown in phantom, to tailor the swirling air flow in secondary chamber 20*a* in a direction that is acceptable to turbine blades, not shown. Tailoring is accomplished both by skewing air feed vanes 98 relative to radial positions and by angling vanes 98 along the primary axis. In other words, the longitudinal axis of vane 98, represented by line segment 110, is not parallel to primary axis 112. Further, air feed vanes 98 also maintain the swirling components of air flow from the combustor to louvres 22*a*, located along inner walls 90 and 92**.

Although specific features of the invention by shown in some drawings and not others, this is for convenience only as each feature may be combined with any or all of the other features in accordance with the invention.

Other embodiments will occur to those skilled in the art and are within the following claims.

What is claimed is:

1. A circumferentially stirred variable residence time vortex slinger combustor comprising:

a primary annular combustion chamber including inner primary and outer primary walls for containing an annular combustion vortex, one of said inner primary walls and said outer primary walls defining a first group of louvres peripherally disposed about said primary combustion chamber and longitudinally distributed along its primary axis, said louvres inclined to impel air circumferentially about the primary axis within said primary combustion chamber to cool its interior surfaces, to impel air inwardly to assist in driving the annular combustion vortex in a helical path, and to feed combustion in said primary combustion chamber;

means for introducing fuel from at least one fuel nozzle, rotating about the primary axis, into said primary annular combustion chamber;

a secondary annular combustion chamber including inner secondary and outer secondary walls; and a narrow annular waist region, interconnecting the output of said primary combustion chamber with said secondary annular combustion chamber, and defined by a convergence of both of said outer walls, for passing only lower density particles and trapping higher density particles in the annular combustion vortex in said primary annular combustion chamber for substantial combustion.

2. The slinger combustor of claim 1 in which said secondary annular combustor chamber includes a second group of louvres inclined to drive air within said secondary annular combustion chamber in approximately the same helical path established by said first group of louvres in said primary annular combustion chamber, to cool the inner surfaces of said second annular combustion chamber, to complete the combustion process, and to assist in cooling combustion gases.

3. The slinger combustor of claim 2 in which said second group of louvres are inclined to tailor the helical path of the combustor exit gases to that acceptable to a turbine.

4. The slinger combustor of claim 1 further including a series of radially opposed air jets at said waist region to quench combustion gases, minimize formation of nitrogen oxides, and further feed combustion.

5. The slinger combustor of claim 4 in which said air jets includes means for controlling the direction of air at said waist region.

6. The slinger combustor of claim 5 in which said means for controlling includes plates angled to control the direction of air at said waist region.

7. The slinger combustor of claim 1 in which said first group of louvres are inclined to circumferentially drive air within said primary combustion chamber for establishing a vortex generally centered about the primary axis of said primary combustion chamber.

8. The slinger combustor of claim 1 in which said first group of louvres are inclined to impel air approximately tangential to the surfaces of the walls of said primary combustion chamber.

9. The slinger combustor of claim 1 in which said outer primary wall defines a first set of louvres in said first group.

10. The slinger combustor of claim 9 in which said inner and outer primary walls are coaxial.

11. The slinger combustor of claim 9 in which said inner primary wall defines a second set of louvres in said first group to assist in driving the annular combustion vortex.

12. The slinger combustor of claim 9 in which said outer wall of said primary chamber is formed by a plurality imbricate of plates successively arranged about the primary axis to establish a plurality of junctions.

13. The slinger combustor of claim 12 in which each of said plates including interlocking means for interconnecting that plate with adjacent plates.

14. The slinger combustor of claim 12 in which said plates define at each junction at least one slot for establishing at least one louvre at that junction.

15. The slinger combustor of claim 12 in which each of said plurality of plates has portions that overlap adjacent plates to establish a junction.

16. The slinger combustor of claim 15 further including spacer means, disposed between overlapping portions of adjacent plates, for securing the overlapping plates in a spaced relationship to define louvres therebetween.

17. The slinger combustor of claim 12 in which said plurality of plates are made from ceramic plates.

18. The slinger combustor of claim 1 in which at least a portion of said first group of louvres are distributed radially along the primary chamber's axis.

19. The slinger combustor of claim 2 in which said second group of louvres includes said outer secondary wall which defines a first set of louvres in said second group; and said inner secondary wall which defines a second set of louvres in said second group.

20. A circumferentially stirred variable residence time vortex slinger combustor comprising:

a primary annular combustion chamber for containing an annular combustion vortex, said primary combustion chamber having an inner and outer walls, said outer wall established by a plurality of plates successively arranged about the primary axis of said combustor;

a first group of louvres defined by said plates, said louvres inclined in impel air circumferentially about the primary axis within said primary combustion chamber to cool its interior surface, to impel air inwardly to assist in driving the annular combustion vortex in a helical path and to feed combustion in said primary combustion chamber;

a secondary annular combustion chamber including inner secondary and other secondary walls; and a narrow annular waist region defined by a convergence of both of said outer walls, interconnecting the output of said primary combustion chamber with said secondary annular combustion chamber for passing only lower density particles and trapping higher density particles in the annular combustion vortex in said primary annular combustion chamber for substantial combustion.

21. A circumferentially stirred variable residence time vortex slinger combustor comprising:

a primary annular combustion chamber for containing an annular combustion vortex;

a first group of louvres peripherally disposed about said primary combustion chamber and distributed along its primary axis, said louvres inclined to impel air circumferentially about the primary axis within said primary combustion chamber to cool its interior surfaces, to impel air inwardly to assist in driving the annular combustion vortex in a helical path, and to feed combustion in said primary combustion chamber;

means for introducing fuel from at least one fuel nozzle, rotating about the primary axis, into said primary annular combustion chamber;

a secondary annular combustion chamber including a second group of louvers peripherally disposed about said secondary chamber, said secondary chamber including an outer cylindrical wall defining a first set of louvres in said second group and an inner cylindrical wall, coaxial with said outer wall, defining a second set of louvres in said second group; and a narrow annular waist region, interconnecting the output of said primary combustion chamber with said secondary annular combustion chamber, for passing only lower density particles and trapping higher density particles in the annular combustion vortex in said primary annular combustion chamber for substantial combustion.

22. The slinger combustor of claim 21 further including air feed vanes, connected between said inner and outer walls, for feeding air to said fourth set of louvres.

23. The slinger combustor of claim 22 in which said air feed vanes are inclined to enhance air flow in a direction to said fourth set of louvres to assist in driving the annular combustion vortex.

24. The slinger combustor of claim 20 in which said feed vanes are skewed to tailor swirling air flow in said secondary chamber in a direction that is acceptable to a turbine.

25. A circumferentially stirred variable residence time vortex slinger combustor comprising:

a primary annular combustion chamber including a first inner wall and a first outer wall for containing an annular combustion vortex;

a first group of louvres peripherally disposed about said primary combustion chamber and distributed along its primary axis, said louvres inclined to impel air circumferentially about the primary axis within said primary combustion chamber to cool its interior surface, to impel air inwardly to assist in driving the annular combustion vortex in a helical path, and to feed combustion in said primary combustion chamber, said first outer wall defining a first set of louvres in said first group, and said first inner wall defining a second set of louvres in said first group;

means for introducing fuel from a fuel nozzle, rotating about the primary axis, into said primary annular combustion chamber;

a secondary annular combustion chamber including a second outer wall and a second inner wall, said secondary annular combustion chamber including a second group of louvres for driving air within said secondary annular combustion chamber in approximately the same helical path established by said first plurality of louvres to cool the inner surfaces of said secondary annular combustion chamber and to assist in cooling combustion gases, said second outer wall defining a first set of louvres in said second group and said second inner wall defining a second set of louvres in said second group; and a narrow annular waist region, interconnecting the output of said primary combustion chamber with said secondary annular combustion chamber for passing only lower density particles and trapping higher density particles in the annular combustion vertex in said primary annular combustion chamber for substantial combustion, and including a set of radially opposing air jets for quenching the combusting gases and minimizing the formation of nitrogen oxides.

26. The slinger composition of claim 25 further including air feed vanes between said second outer wall and said second inner wall for feeding air to said second and fourth sets of louvres.

* * * * *